US009525955B2

(12) United States Patent
Uehara

(10) Patent No.: US 9,525,955 B2
(45) Date of Patent: Dec. 20, 2016

(54) DIGITAL SPEAKER SYSTEM AND ELECTRICAL CONNECTION METHOD FOR DIGITAL SPEAKER SYSTEM

(71) Applicant: CLARION CO., LTD., Saitama (JP)

(72) Inventor: Masayoshi Uehara, Saitama (JP)

(73) Assignee: CLARION CO., LTD., Saitama-Shi, Saitama (JP)

( * ) Notice: Subject to any disclaimer, the term of this patent is extended or adjusted under 35 U.S.C. 154(b) by 0 days.

(21) Appl. No.: 14/647,681

(22) PCT Filed: Oct. 25, 2013

(86) PCT No.: PCT/JP2013/078909
§ 371 (c)(1),
(2) Date: May 27, 2015

(87) PCT Pub. No.: WO2014/083981
PCT Pub. Date: Jun. 5, 2014

(65) Prior Publication Data

US 2015/0319548 A1 Nov. 5, 2015

(30) Foreign Application Priority Data

Nov. 28, 2012 (JP) ..... 2012-259494

(51) Int. Cl.
*H04R 5/02* (2006.01)
*H04S 1/00* (2006.01)
(Continued)

(52) U.S. Cl.
CPC . *H04S 1/00* (2013.01); *H04R 3/12* (2013.01); *H04S 3/008* (2013.01); *H04S 2400/05* (2013.01)

(58) Field of Classification Search
CPC ..... H04R 5/04; H04R 5/02; H04R 1/403; H04R 1/2834; H04R 1/2803; H04R 1/2857; H04R 9/06; H04R 1/02; H04R 2201/021; H04R 2227/001; H04R 2440/05; H04R 2460/01; H04R 2499/13; H04R 27/00; H04R 7/045; H04R 9/066; H04R 1/26; H04R 1/30; H04R 1/1403; H04R 2307/207; H04R 3/12; H04R 7/04
(Continued)

(56) References Cited

U.S. PATENT DOCUMENTS 3,417,203 A 12/1968 Hafler
5,838,800 A * 11/1998 Lowe ..... H04S 1/002 381/1
(Continued)

FOREIGN PATENT DOCUMENTS

EP 0810810 A2 12/1997
EP 2515555 A1 10/2012
(Continued)

OTHER PUBLICATIONS

International Preliminary Report on Patentability issued in corresponding PCT/JP2013/078909 application.
(Continued)

*Primary Examiner* — Akelaw Teshale
(74) *Attorney, Agent, or Firm* — IP Business Solutions, LLC

(57) ABSTRACT

A digital speaker system that effectively uses the characteristic of a signal processing circuit is constructed. A digital speaker system 1 having plural speakers has a signal processing circuit 10 for outputting plural right-sound digital signals and plural left-sound digital signals, and at least one of the plural speakers is operated to function as a monaural sound speaker 2 to which any one or plural right-sound digital signals output from the signal processing circuit 10 and any left-sound digital signals whose number corre-
(Continued)

HEAVY LINE ··· SIGNAL LINE FOR RIGHT-SOUND DIGITAL SIGNAL
THIN LINE ··· SIGNAL LINE FOR LEFT-SOUND DIGITAL SIGNAL sponds to the number of the signals are input to output monaural sounds.

5 Claims, 6 Drawing Sheets

(51) Int. Cl.
*H04R 3/12* (2006.01)
*H04S 3/00* (2006.01)

(58) Field of Classification Search
USPC ..... 381/17, 300, 335, 351, 86, 182, 27, 302,381/304, 306, 333, 42, 349, 361, 386, 389, 400,381/401, 89
See application file for complete search history.

(56) References Cited

U.S. PATENT DOCUMENTS 5,896,456 A * 4/1999 Desper ..... H04S 1/002 381/1
6,819,767 B1 * 11/2004 Funahashi ..... H04R 5/02 381/182
2007/0127766 A1 * 6/2007 Combest ..... H04R 5/04 381/401
2007/0269062 A1 * 11/2007 Rodigast ..... H04R 1/403 381/310
2009/0110217 A1 4/2009 Yasuda et al.
2010/0054484 A1 * 3/2010 Fincham ..... H04S 3/002 381/17
2010/0239101 A1 9/2010 Okamura et al.
2011/0160883 A1 6/2011 Yasuda et al.
2012/0033826 A1 * 2/2012 Kakumoto ..... H04R 1/28 381/86
2013/0022219 A1 1/2013 Takada et al.
2013/0156231 A1 6/2013 Yasuda et al.
2016/0007132 A1 * 1/2016 Peters ..... G10L 19/008 381/17
2016/0205471 A1 7/2016 Yasuda et al.

FOREIGN PATENT DOCUMENTS

JP 2010-028785 A 2/2010
JP 2011-223289 A 11/2011
JP 2012-227589 A 11/2012
WO 2007135928 A1 11/2007
WO WO2011/074341 A 6/2011

OTHER PUBLICATIONS

International Search Report dated Jan. 14, 2014 issued in corresponding PCT/JP2013/078909.
English Abstract and Machine Translation for 2012-227589 Publication Date: Nov. 15, 2012.
Extended European Search Report issued on Jun. 2, 2016 in the corresponding European Patent Application No. 13858177.
Japanese Office Action issued on Jun. 21, 2016 in the corresponding Japanese Patent Application No. 2014-550091.

* cited by examiner

HEAVY LINE ··· SIGNAL LINE FOR RIGHT-SOUND DIGITAL SIGNAL
THIN LINE ··· SIGNAL LINE FOR LEFT-SOUND DIGITAL SIGNAL

HEAVY LINE ···. SIGNAL LINE FOR ANALOG AUDIO SIGNAL OF RIGHT CHANNEL
THIN LINE ··· SIGNAL LINE FOR ANALOG AUDIO SIGNAL OF LEFT CHANNEL

HEAVY LINE ··· SIGNAL LINE FOR RIGHT-SOUND DIGITAL SIGNAL
THIN LINE ··· SIGNAL LINE FOR LEFT-SOUND DIGITAL SIGNAL

HEAVY LINE ··· SIGNAL LINE FOR RIGHT-SOUND DIGITAL SIGNAL
THIN LINE ··· SIGNAL LINE FOR LEFT-SOUND DIGITAL SIGNAL

HEAVY LINE ··· SIGNAL LINE FOR RIGHT-SOUND DIGITAL SIGNAL
THIN LINE ··· SIGNAL LINE FOR LEFT-SOUND DIGITAL SIGNAL

HEAVY LINE ··· SIGNAL LINE FOR RIGHT-SOUND DIGITAL SIGNAL
THIN LINE ··· SIGNAL LINE FOR LEFT-SOUND DIGITAL SIGNAL

DIGITAL SPEAKER SYSTEM AND ELECTRICAL CONNECTION METHOD FOR DIGITAL SPEAKER SYSTEM

TECHNICAL FIELD

The present invention relates to a digital speaker system configured to have a digital speaker to which digital signals are input, and an electrical connection method for the digital speaker system.

BACKGROUND ART

A digital speaker which operates based on digital signals input from a signal processing circuit (driving circuit) has been proposed (see Patent Document 1, for example).

PRIOR ART DOCUMENT

Patent Document

Patent Document 1: JP-A-2010-28785

SUMMARY OF THE INVENTION

Problem to be Solved by the Invention

Here, the signal processing circuit used for the digital speaker is characterized by being capable of subjecting digital audio signals input from a sound source such as an audio device or the like to predetermined digital processing and generating and outputting multi-channel signals (of three channels, for example) for each of digital signals for right sounds and digital signals for left sounds. There has been needs for configuring a digital speaker system by effectively utilizing such a characteristic of the signal processing circuit.

The present invention has been implemented in view of the foregoing situation, and has an object to configure a digital speaker system which effectively utilizes the characteristic of the signal processing circuit and provide an electrical connection method for the digital speaker system.

Means of Solving the Problem

In order to attain the above object, according to the present invention, a speaker system having a plurality of speakers is characterized by further comprising a signal processing circuit that outputs a plurality of right-sound digital signals and a plurality of left-sound digital signals, wherein at least one of the plurality of speakers is operated to function as a monaural sound speaker to which any one or plural right-sound digital signals output from the signal processing circuit and any left-sound digital signals whose number corresponds to the number of the right-sound digital signals are input to output monaural sounds.

The present invention is characterized by further comprising a right sound speaker to which one or plural right-sound digital signals that are not input to the monaural sound speaker are input to output right sounds, and a left sound speaker to which one or plural left-sound digital signals that are not input to the monaural sound speaker are input to output left sounds.

The present invention is characterized in that the speakers are configured to be of the same type under a construction that the same number of digital signals are input to each of the speakers.

According to the present invention, a wire connection method for a digital speaker system having a plurality of speakers and a signal processing circuit for outputting a plurality of right-sound digital signals and a plurality of left-sound digital signals is characterized in that any one or plural right-sound digital signals output from the signal processing circuit and any left-sound digital signals whose number corresponds to the number of the right-sound digital signals are input to at least one of the plurality of speakers to output monaural sounds.

The present invention is characterized in that one or plural right-sound digital signals are input to speakers other than the at least one speaker for outputting the monaural sounds to output right sounds, and one or plural left-sound digital signals are input to speakers other than the at least one speaker for outputting the monaural sounds and the speakers for outputting the right sounds to output left sounds.

Effect of the Invention

According to the present invention, a digital speaker system can be constructed by effectively utilizing the characteristic of a signal processing circuit, and a wire connection method for the digital speaker system can be provided.

BEST MODES FOR CARRYING OUT THE INVENTION

Embodiments according to the present invention will be described hereunder with reference to the drawings.

Figure 1:
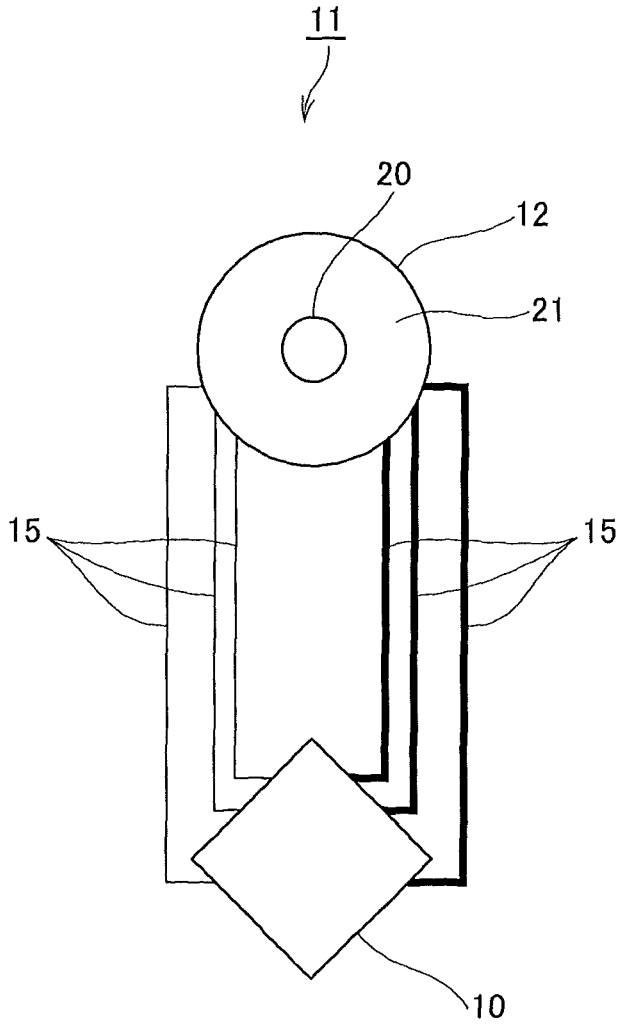
FIG. 1 is a diagram showing the construction of a digital speaker 11 according to an embodiment.

FIG. 1 is a diagram which schematically shows the construction of a digital speaker 11 in a descriptively suitable style to describe the function of a signal processing circuit 10 according to an embodiment of the present invention.

The digital speaker 11 is a speaker which is connected to a stationary, portable or in-vehicle mount type music player, a cellular phone, a tablet terminal or other sound sources in wired or wireless connection style and outputs sounds on the basis of digital audio signals input from the sound source.

As shown in FIG. 1, the digital speaker 11 has a signal processing circuit 10 and a speaker main body 12.

The signal processing circuit 10 is provided with a connector (not shown), and a cable for inputting digital audio signals from a sound source is connected to the connector.

The signal processing circuit 10 subjects input digital audio signals to predetermined signal processing, and generates and outputs digital signals for right sounds of three channels and digital signals for left sounds of three channels.

Specifically, a ΔΣ modulation circuit and digital circuits such as a predetermined filter circuit, etc. are mounted in the signal processing circuit 10, and the signal processing circuit 10 subjects the input digital audio signals to signal processing such as predetermined sampling processing, filtering processing, etc. with the functions of the above circuits, thereby generating the digital signals of the right and left six channels. Then, the signal processing circuit 10 amplifies the generated digital signals of the right and left six channels by six digital amplifiers (not shown) which are individually provided to each of the channels, and outputs the amplified digital signals through six signal lines 15 which are individually provided to each of the channels. Each of the signal lines 15 physically has two signal transmission lines (for example, tinsel wires) corresponding to plus and minus respectively, and in consideration of convenience of description, these lines are omitted from the illustration of FIG. 1, and the detailed description thereof is omitted from the following description.

The speaker main body 12 has a bobbin 20 and a diaphragm 21 supported by the bobbin 20. The bobbin 20 is equipped with voice coils of six layers (not shown), and signal lines 15 of respective channels are electrically connected to the voice coils of the respective layers. The voice coils are stacked to be multi-layered in the peripheral direction of the bobbin 20, and the layers thereof are also arranged to be spaced at intervals in the axial direction of the bobbin 20.

When sounds are output by the digital speaker 11, digital audio signals are input from a sound source to the signal processing circuit 10, and digital signals of right and left six channels based on the digital audio signals are input as driving signals from the signal processing circuit 10 through the signals lines 15 of the respective channels to the voice coils of the respective layers. The input of the digital signals as the driving signals actuates the voice coils located at a magnetic gap, the actuation of the voice coils vibrates the diaphragm 21, and sounds are output in accordance with the vibration of the diaphragm 21.

As described above, the signal processing circuit 10 of this embodiment is characterized by executing predetermined digital processing on the digital audio signals input from the sound source to enable generation and output of digital signals for right sound of three channels and digital signals for left sound of three channels. According to this embodiment, a digital speaker system 1 which is configured to contain a monaural sound speaker 2 for outputting monaural sounds, a right sound speaker 3 for outputting right sounds of stereo sounds and a left sound speaker 4 for outputting left sounds (described later) of the stereo sounds is properly constructed by effectively using the above characteristic.

First, a conventional analog speaker system will be first described. After the problem of the analog speaker system will be described, the digital speaker system 1 according to this embodiment will be described.

Figure 2:
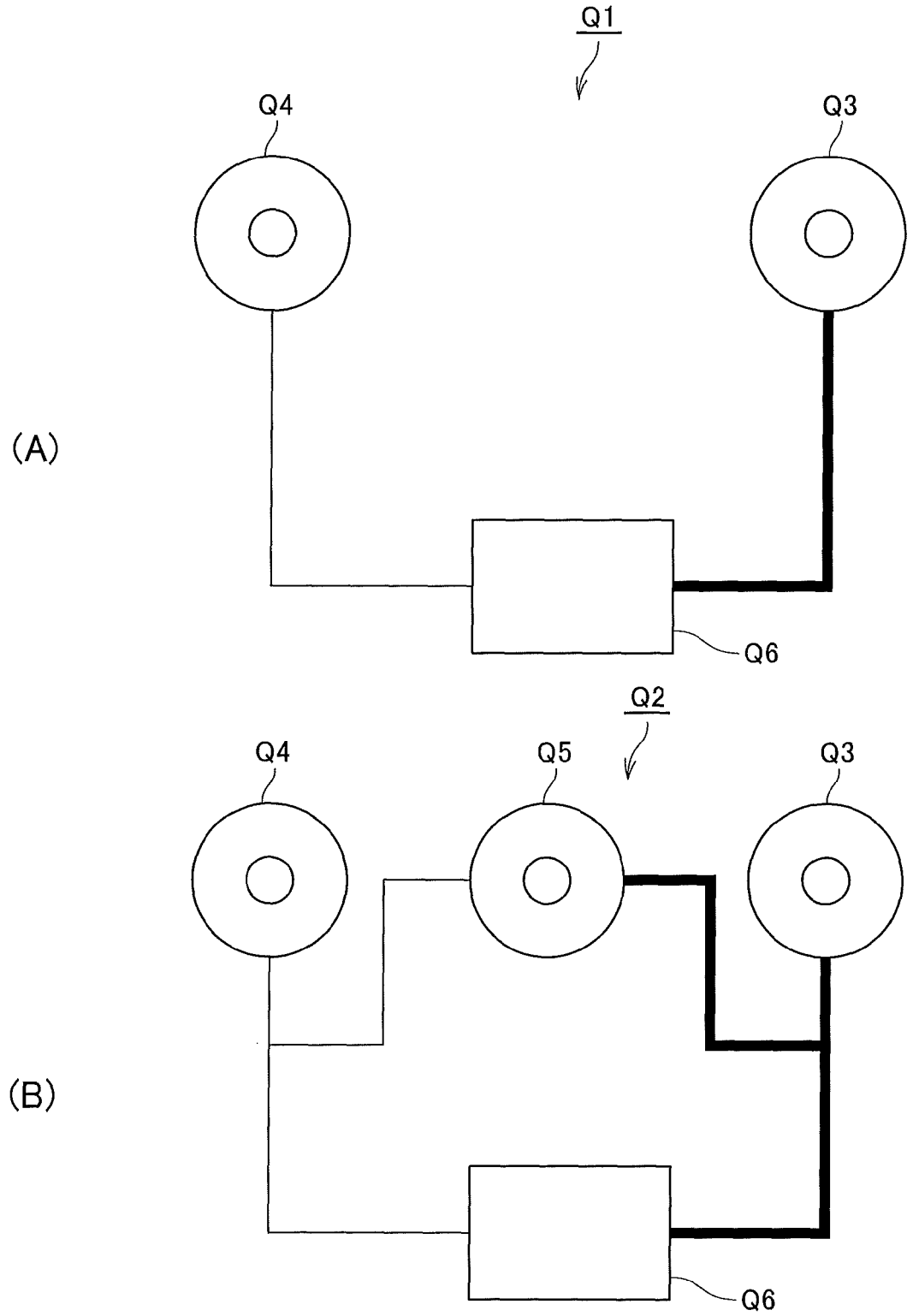
FIG. 2 is a diagram used to describe a conventional analog speaker system.

FIG. 2 is a diagram used to describe the conventional analog speaker system, wherein (A) represents a first analog speaker system Q1 as a general analog speaker system for stereo reproduction which has a right speaker Q3 for a right channel and a left speaker Q4 for a left channel, and (B) represents a second analog speaker system Q2 which is constructed by adding a center speaker Q5 to the first analog speaker system Q1 shown in FIG. 2(A).

As shown in FIG. 2(A), the first analog speaker system Q1 has an analog amplifier Q6. An analog audio signal of the right channel is amplified by the amplifier and output to the right speaker Q3 to thereby output right sounds from the right speaker while an analog audio signal of the left channel is likewise amplified by the amplifier and output to the left speaker Q4 to thereby output left sounds from the left speaker, whereby stereo reproduction is performed.

There will be considered such a case that the first analog speaker system Q1 as described above is added with the center speaker Q5 as shown in FIG. 2(B) to construct a speaker system having center, right and left speakers.

In this case, it is considered that a signal line for connecting the analog amplifier Q6 and the right speaker Q3 is branched and the branched signal line is connected to a terminal of the center speaker Q5 while a signal line for connecting the analog amplifier Q6 and the left speaker Q4 is branched and the branched signal line is connected to the other terminal of the center speaker Q5 as shown in FIG. 2(B). The speaker system having the center, right and left speakers can be constructed as described above, but the following problem occurs in such a case.

That is, in this construction, the analog audio signal of the right channel and the analog audio signal of the left channel are directly combined with each other in the center speaker Q5, so that distortion of these signals may be amplified.

Furthermore, since there is not any amplifier dedicated to the center speaker Q5, it is impossible to adjust the level of the sound pressure of the center speaker Q5 independently. When an amplifier dedicated to the center speaker Q5 is equipped to solve this problem, it is necessary to generate an analog audio signal of the center channel with a pre-amplifier and then output the analog audio signal of the center channel to the center speaker Q5 through the dedicated amplifier, so that the circuit scale increases.

According to this embodiment, the speaker system having the center, right and left speakers is constructed on the condition that the characteristic of the signal processing circuit 10 is effectively used and the problem of the prior art as described above is solved, thereby improving localization and resolution of sounds.

Figure 3:
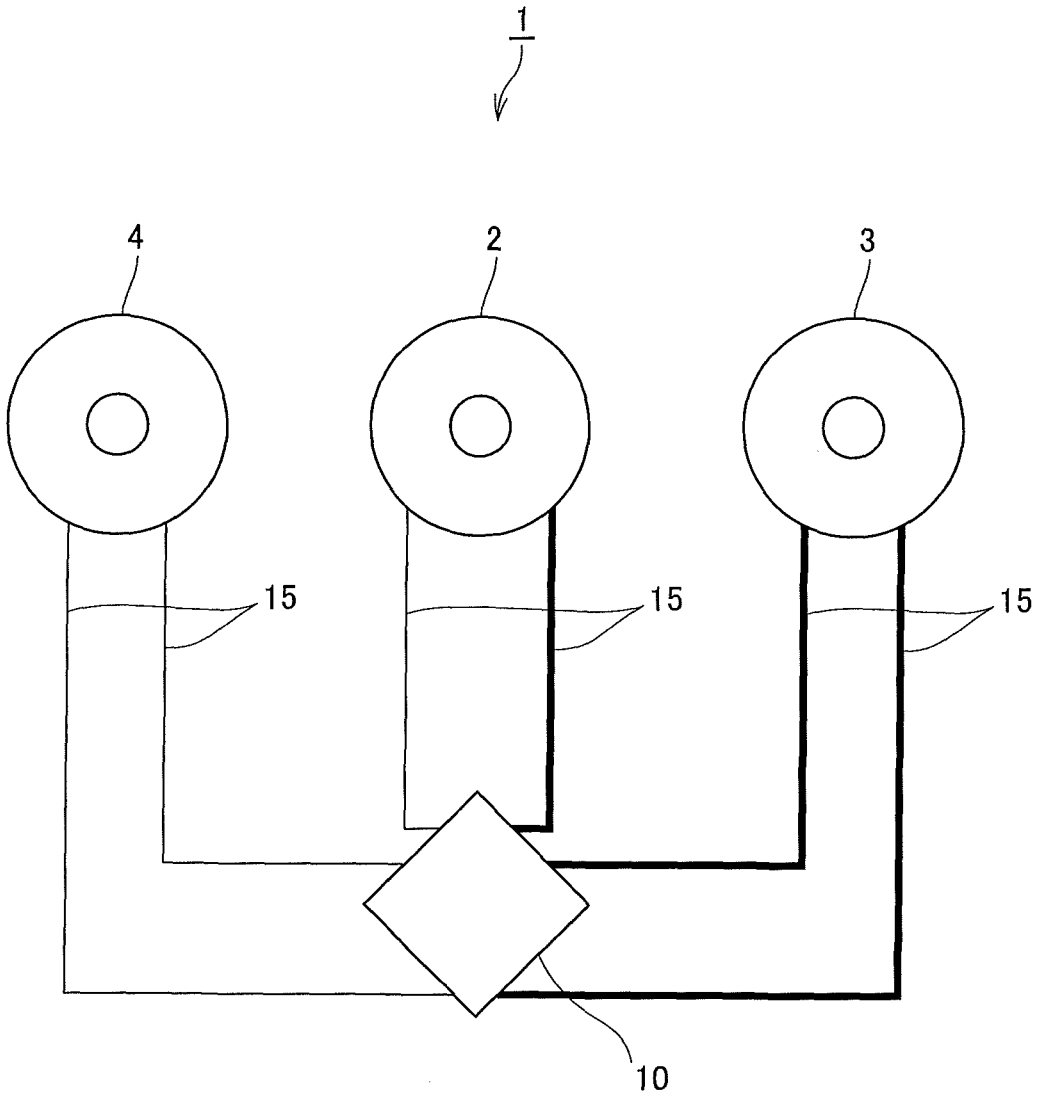
FIG. 3 is a diagram showing the construction of a digital speaker system 1.

FIG. 3 is a schematic diagram showing the construction of the digital speaker system 1 according to this embodiment.

As shown in FIG. 3, the digital speaker system 1 is a speaker system having center, right and left speakers, and configured to contain a monaural sound speaker 2 (a speaker corresponding to the center speaker Q5), a right sound speaker 3 (a speaker corresponding to the right speaker Q3) and a left sound speaker 4 (a speaker corresponding to the left speaker Q4).

As shown in FIG. 3, any one of right-sound digital signals of three channels is input to the monaural sound speaker 2, and any one of left-sound digital signals of three channels is input to the monaural sound speaker 2.

As described above, according to the digital speaker system 1 of this embodiment, attention is paid to the feature that the signal processing circuit 10 generates and outputs right-sound digital signals of multi-channel (plural channels) and left-sound digital signals of multi-channel (plural channels), any one or plural (one in this embodiment) right-sound digital signal and any left-sound digital signals whose number corresponds to the number of the signals (one in this embodiment) are input to the monaural sound speaker 2, whereby output of the monaural sounds based on the monaural sound speaker 2 can be implemented.

The following effect can be achieved by the construction as described above.

That is, the right and left digital audio signals to be input to the monaural sound speaker 2 are digital signals which are generated on the assumption that they are respectively input to some of the multi-layered voice coils equipped to the bobbin 20 and combined with each other as described with reference to FIG. 1. Therefore, there is little dispersion in characteristic between the right and left digital audio signals, and thus there is little distortion when the respective signals are combined with each other. Particularly, as compared with the case where the analog audio signal of the right channel and the analog audio signal of the left channel are combined with each other, the distortion is more remarkably lower.

Furthermore, as described above, the signal processing circuit 10 has digital amplifiers each of which is provided for each channel (for each digital audio signal to be output). Therefore, the digital speaker system 1 is not required to have any dedicated pre-amplifier and amplifier unlike the conventional second analog speaker system Q2, and thus it can adjust the level of the sound pressure of the monaural sound speaker 2 independently. That is, in the digital speaker system 1, the sound pressure of the monaural sound speaker 2 can be adjusted without increasing the circuit scale by effectively using an existing digital amplifier for the signal processing circuit 10.

Furthermore, as shown in FIG. 3, the two right-sound digital signals which are not input to the monaural sound speaker 2 are input to the right sound speaker 3. Under this construction, only the right sound digital signal are input to the right sound speaker 3, and sounds for right are properly output. That is, according to the digital speaker system 1 according to this embodiment, upon paying attention to the feature that the signal processing circuit 10 generates and outputs the multi-channel (plural) right sound digital signals and the multi-channel (plural) left sound digital signals, the digital speaker system 1 is configured so that the right sound digital signals which are not input to the monaural sound speaker 2 are input to the right sound speaker 3, whereby the output of sounds for right based on the right sound speaker 3 is implemented.

Likewise, the digital speaker system 1 is configured so that the two left sound digital signals which are not input to the monaural sound speaker 2 are input to the left sound speaker 4. The effect based on this construction is identical to the effect of the right sound speaker 3.

Furthermore, as shown in FIG. 3, the digital speaker system 1 according to this embodiment is configured so that the digital audio signals of two channels are input to each of the three speakers (the monaural sound speaker 2, the right sound speaker 3 and the left sound speaker 4) constituting this system. The following effect can be achieved by this construction.

That is, the same number of the channels of the digital audio signals to be input is set to each of the speakers constituting the digital speaker system 1, whereby the same number of the input terminals can be set to each of the speakers. Therefore, the same type speakers can be adopted as the speakers. Therefore, in order to construct the digital speaker system 1, it is unnecessary to prepare different types and respective proper numbers of speakers, and the same type and required number of speakers may be prepared, thereby performing enhancement of facilitation of the construction, reduction of the types of parts and reduction of the manufacturing cost.

Particularly, in this embodiment, the digital audio signals of two channels are input to each of the three speakers constituting the digital speaker system 1. Therefore, a generally prevailing analog speaker having two input terminals is applicable as each of the three speakers constituting the digital speaker system 1, and the further enhancement of the easiness of the construction, the further reduction of the types of parts and the further reduction of the manufacturing cost can be performed.

As described above, in this embodiment, the digital speaker system 1 has the signal processing circuit 10 for outputting the plural right-sound digital signals and the plural left-sound digital signals, and the monaural sound speaker 2 which is supplied with any one or plural right-sound digital signals output from the signal processing circuit 10 and any left-sound digital signals which are output from the signal processing circuit 10 and whose number corresponds to the number of the signals, thereby outputting monaural sounds.

That is, the signal processing circuit 10, the monaural sound speaker 2, the right sound speaker 3 and the left sound speaker 4 are connected with one another through wires by a proper method so that the above construction is achieved.

According to this construction, by effectively using the characteristic of the signal processing circuit 10 that the signal processing circuit 10 can generate and output right-sound digital signals of three channels and left-sound digital signals of three channels by executing predetermined digital processing on digital audio signals input from a sound source, the construction of the speaker system having the monaural sound speaker that can adjust the level of the sound pressure independently without enlarging the circuit board can be implemented.

Furthermore, the digital speaker system 1 according to this embodiment further has the right sound speaker 3 to which one or plural right-sound digital signals which are not input to the monaural sound speaker 2 are input to output right sounds, and the left sound speaker 4 to which one or plural left-sound digital signals which are not input to the monaural sound speaker are input to output left sounds.

According to this construction, the speaker system which has not only the monaural sound speaker 2, but also the right speaker for properly outputting sounds for right and the left speaker for properly outputting sounds for left can be constructed by using the characteristic of the signal processing circuit 10.

Furthermore, according to this embodiment, the digital speaker system 1 is configured so that the number of the digital audio signals to be input is set to be equal among the speakers constituting the digital speaker system 1, and the respective speakers are constructed by the same type of speaker.

According to this construction, when the digital speaker system 1 is constructed, it is sufficient only to prepare the same type and required number of speakers without preparing different types and respective proper numbers of speakers, and the enhancement of the easiness of the construction, the reduction of the types of parts and the reduction of the manufacturing cost can be performed.

OTHER EXAMPLES

By applying the present invention, various types of speaker systems in which localization and resolution are improved can be constructed. Speaker systems to which the present invention is applied will be described by using specific examples.

Example 1

Figure 4:
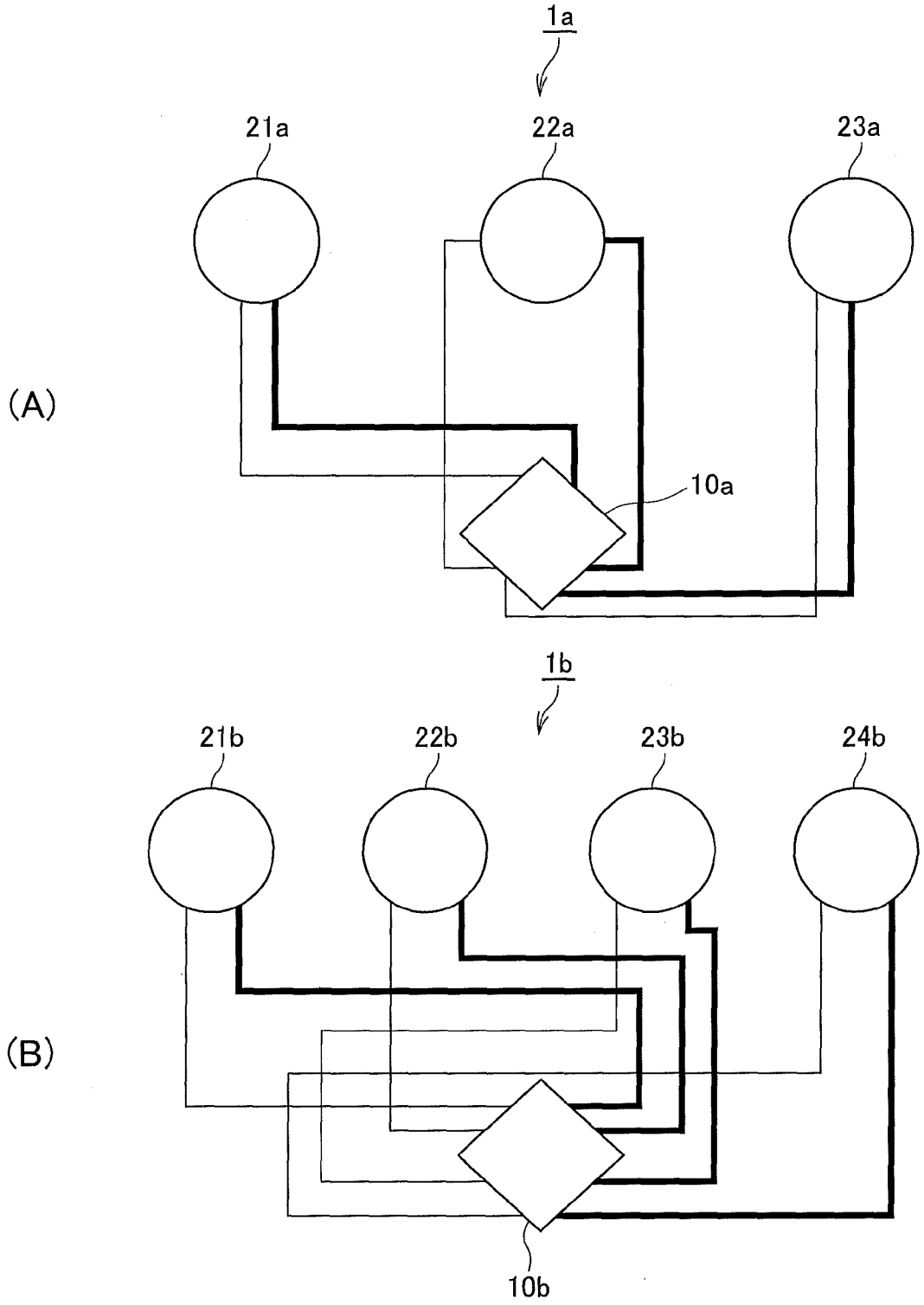
FIG. 4 (A) shows the digital speaker system according to an embodiment 1, and (B) is a diagram showing a digital speaker system according to an embodiment 2.

FIG. 4 (A) is a diagram showing the construction of a digital speaker system 1*a* of an example 1.

A signal processing circuit 10*a* of this example 1 generates and outputs right-sound digital signals of three channels and left-sound digital signals of three channels. The digital speaker system 1*a* has three monaural sound speakers 21*a* to 23*a*, and a right-sound digital signal of one channel and a left-sound digital signal of one channel are input to each of the three speakers.

Under the above construction, each of the three speakers constituting the digital speaker system 1*a* functions as a monaural sound speaker operating based on the right-sound digital signal and the left-sound digital signal.

According to the construction of the digital speaker system 1*a* of this example 1, the speaker system having the three monaural sound speakers which can adjust the level of the sound level independently can be constructed without enlarging the circuit board by effectively using the characteristic of the signal processing circuit 10*a* that the signal processing circuit 10*a* can output the right-sound digital signals of the three channels and the left-sound digital signals of the three channels.

Example 2

FIG. 4(B) is a diagram showing the construction of a digital speaker system of an example 2.

The signal processing circuit 10*b* according to the example 2 generates and outputs right-sound digital signals of four channels and left-sound digital signals of four channels unlike the above embodiment. The digital speaker system 1*b* has four monaural sound speakers 21*b* to 24*b*, and a right-sound digital signal of one channel and a left-sound digital signal of one channel are input to each of the four speakers.

Under the above construction, each of the four speakers constituting the digital speaker system 1*b* functions as a monaural sound speaker operating on the basis of the right-sound digital signal and the left-sound digital signal.

According to the construction of the digital speaker system of this example 2, the speaker system having the four monaural sound speakers which can adjust the level of the sound level independently can be constructed without enlarging the circuit board by effectively using the characteristic of the signal processing circuit 10*b* that the signal processing circuit 10*b* can output the right-sound digital signals of the four channels and the left-sound digital signals of the four channels.

Example 3

Figure 5:
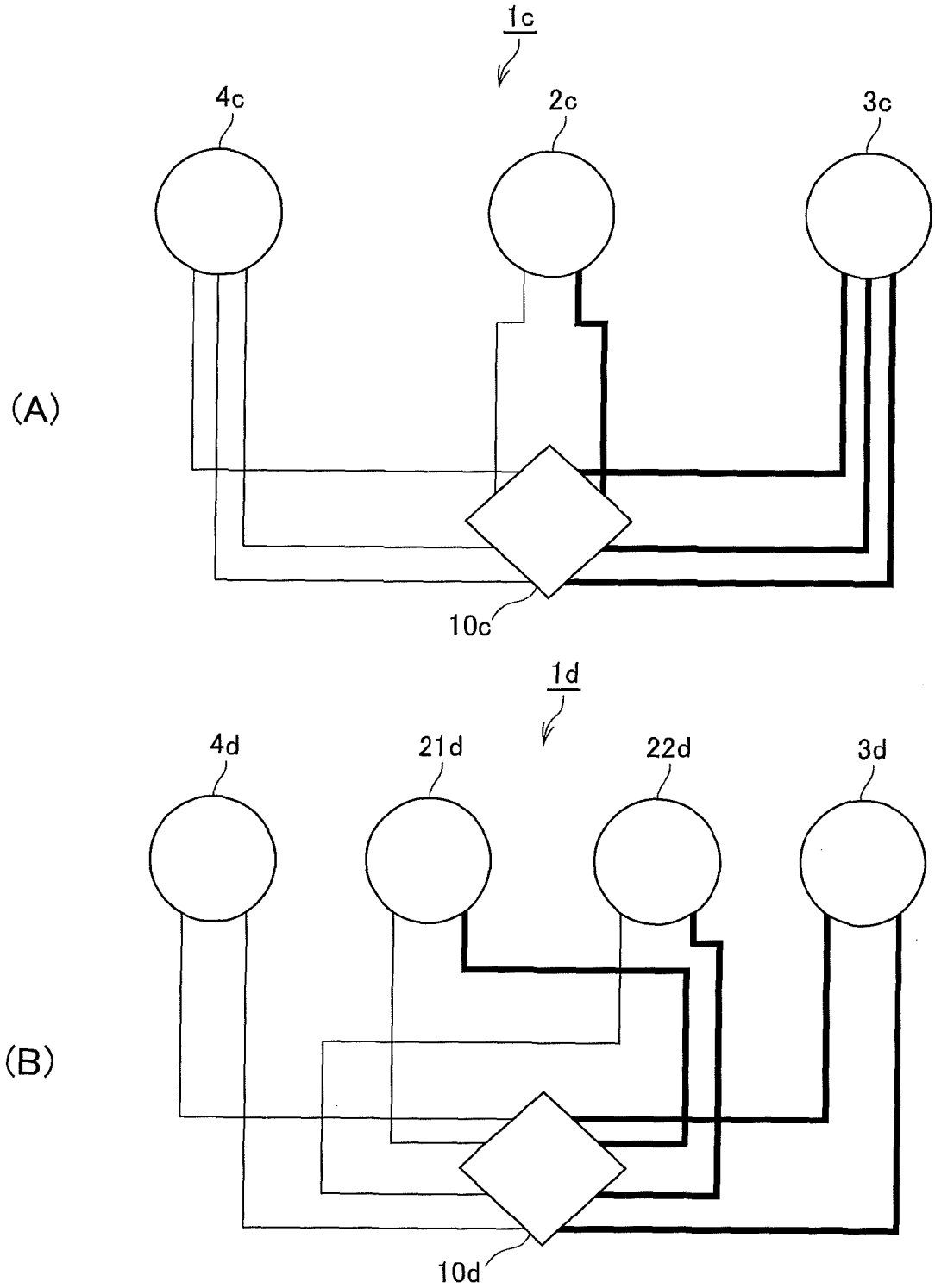
FIG. 5 (A) shows a digital speaker system according to an embodiment 3, and (B) is a diagram showing a digital speaker system according to an embodiment 4.

FIG. 5(A) is a diagram showing the construction of a digital speaker system 1*c* according to an example 3.

A signal processing circuit 10*c* according to the example 3 generates and outputs right-sound digital signals of four channels and left-sound digital signals of four channels unlike the above embodiment. The digital speaker system 1*c* has a monaural sound speaker 2*c*, a right sound speaker 3*c* and a left sound speaker 4*c*. A right-sound digital signal of one channel and a left-sound digital signal of one channel are input to the monaural sound speaker 2*c*, right-sound digital signals of three channels are input to the right sound speaker 3*c*, and left-sound digital signals of three channels are input to the left sound speaker 4*c*.

Under the above construction, the monaural sound speaker 2*c* constituting the digital speaker system 1*c* functions as a monaural sound speaker operating based on the right-sound digital signal and the left-sound digital signal, the right-sound speaker 3 functions as a right sound speaker operating based on only the right-sound digital signals, and the left sound speaker 4*c* functions as a left sound speaker operating based on only the left-sound digital signals.

According to the construction of the digital speaker system 1*c* of the example 3, the speaker system having the monaural sound speaker which can adjust the level of the sound pressure independently, the right sound speaker and the left sound speaker can be constructed by effectively using the characteristic of the signal processing circuit 10*c* that the signal processing circuit 10*c* can output the right-sound digital signals of four channels and left-sound digital signals of four channels.

Example 4

FIG. 5(B) is a diagram showing the construction of a digital speaker system 1*d* of an example 4.

A signal processing circuit 10*d* according to an example 4 generates and outputs right-sound digital signals of four channels and left-sound digital signals of four channels unlike the above embodiment. The digital speaker system 1*d* has two monaural sound speakers 21*d*, 22*d*, a right sound speaker 3*d* and a left sound speaker 4*d*. A right-sound digital signal of one channel and a left-sound digital signal of one channel are input to each of the two monaural sound speakers 21*d*, 22*d*, right-sound digital signals of two channels are input to the right sound speaker 3*d*, and left-sound digital signals of two channels are input to the left-sound speaker 4*d*.

Under the above construction, each of the two monaural speakers 21*d*, 22*d* constituting the digital speaker system 1*d* functions as a monaural speaker operating based on the right-sound digital signal and the left-sound digital signal, the right sound speaker 3*d* functions as a right sound speaker operating based on only the right-sound digital signals, and the left sound speaker 4*d* functions as a left sound speaker operating based on only the left-sound digital signals.

According to the construction of the digital speaker system 1*d* of the example 4, the speaker system having the two monaural sound speakers which can adjust the level of the sound pressure independently, the right sound speaker and the left sound speaker can be constructed without enlarging the circuit board by effectively using the characteristic of the signal processing circuit 10*d* that the signal processing circuit 10*d* can output right-sound digital signals of four channels and left-sound digital signals of four channels.

Example 5

Figure 6:
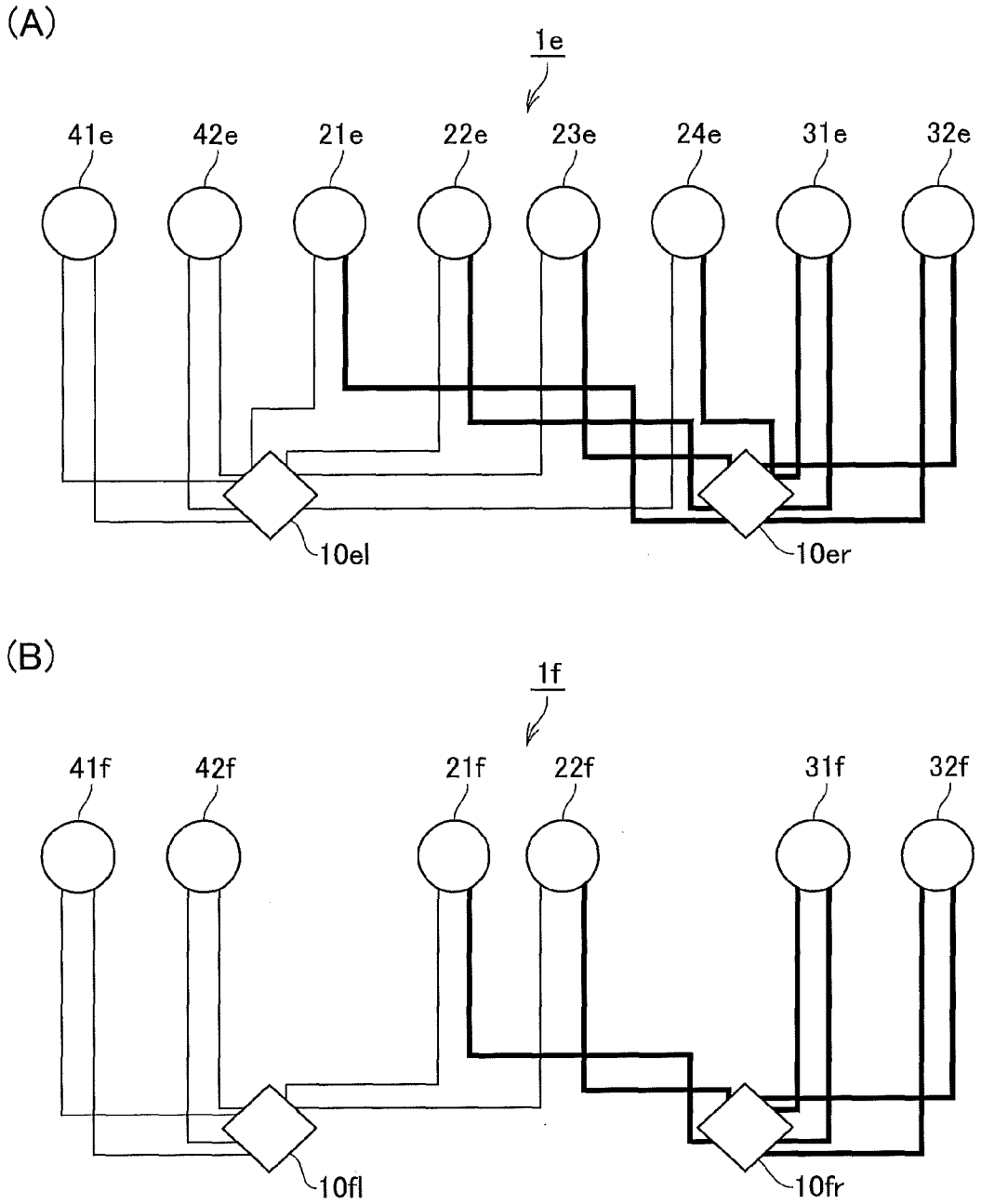
FIG. 6 (A) shows a digital speaker system according to an embodiment 5, and (B) is a diagram showing a digital speaker system according to an embodiment 6.

FIG. 6 (A) is a diagram showing the construction of a digital speaker system 1*e* of an example 5.

The digital speaker system 1*e* according to the example 5 has two signal processing circuits 10*er, el*, and the two signal processing circuits 10*er, el* function as "a signal processing circuit for outputting plural right-sound digital signals and plural left-sound digital signals" in cooperation with each other.

The signal processing circuit 10*er* generates and outputs right-sound digital signals of eight channels, and the signal processing circuit 10*el* generates and outputs left-sound digital signals of eight channels.

The digital speaker system 1*e* has four monaural sound speakers 21*e* to 24*e*, two right sound speakers 31*e*, 32*e* and two left sound speakers 41*e*, 42*e*.

A right-sound digital signal of one channel and a left-sound digital signal of one channel are input to each of the four monaural sound speakers 21*e* to 24*e*. That is, any one right-sound digital signal of the signal processing circuit 10*er* is input to each of the four monaural sound speakers 21*e* to 24*e*, and also any one left-sound digital signal of the signal processing circuit 10*el* is input to each of the four monaural sound speakers 21*e* to 24*e*.

Right-sound digital signals of any two channels output from the signal processing circuit 10*er* are input to each of the two right sound speakers 31*e*, 32*e*. Left-sound digital signals of any two channels output from the signal processing circuit 10*el* are input to each of the two left sound speakers 41*e*, 42*e*.

Under the construction as described above, each of the four monaural sound speakers 21*e* to 24*e* constituting the digital speaker system 1*e* functions as a monaural sound speaker operating based on the right-sound digital signal and the left-sound digital signal, each of the two right sound speakers 31*e*, 32*e* functions as a right sound speaker operating based on only the right-sound digital signals, and each of the two left sound speakers 41*e*, 42*e* functions as a left sound speaker operating based on only the left-sound digital signals.

According to the construction of the digital speaker system 1*e* of the example 5, the speaker system having the four monaural sound speakers which can adjust the level of the sound pressure independently, the two right sound speakers and the two left sound speakers can be constructed without enlarging the circuit board by effectively using the feature that the digital speaker system 1*e* has the signal processing circuit 10*er* for outputting the right-sound digital signals of eight channels and the signal processing circuit 10*el* for outputting the left-sound digital signals of eight channels.

Example 6

FIG. 6 (B) is a diagram showing the construction of a digital speaker system 1*f* of an example 6.

The digital speaker system 1*f* according to this example 6 has two signal processing circuits 10*fr*, 10*fl*, and the two signal processing circuits 10*fr*, 10*fl* function as "a signal processing circuit for outputting plural right-sound digital signals and plural left-sound digital signals" in cooperation with each other.

The signal processing circuit 10*fr* generates and outputs right-sound digital signals of six channels, and the signal processing circuit 10*fl* generates and outputs left-sound digital signals of six channels.

The digital speaker system 1*f* has two monaural sound speakers 21*f*, 22*f*, two right sound speakers 31*f*, 32*f* and two left sound speakers 41*f*, 42*f*.

A right-sound digital signal of one channel and a left-sound digital signal of one channel are input to each of the two monaural sound speakers 21*f*, 22*f*. That is, any one right-sound digital signal of the signal processing circuit 10*fr* is input to each of the two monaural sound speakers 21*f*, 22*f*, and any one left-sound digital signal of the signal processing circuit 10*fl* is input to each of the two monaural sound speakers 21*f*, 22*f*.

Right-sound digital signals of any two channels output from the signal processing circuit 10*fr* are input to each of the two right sound speakers 31*f*, 32*f*. Left-sound digital signals of any two channels output from the signal processing circuit 10*fl* are input to each of the two left sound speakers 41*f*, 42*f*.

Under the construction as described above, each of the two monaural sound speakers 21*f*, 22*f* constituting the digital speaker system 1*f* functions as a monaural sound speaker operating based on the right-sound digital signal and the left-sound digital signal, each of the two right sound speakers 31*f*, 32*f* functions as a right sound speaker which is operated based on only the right-sound digital signals, and each of the left sound speakers 41*f*, 42*f* functions as a left sound speaker operating based on only the left-sound digital signals.

According to the digital speaker system 1*f* of this example 6, the speaker system having the two monaural sound speakers which can adjust the level of the sound pressure independently, the two right sound speakers and the two left sound speakers can be constructed without enlarging the circuit board by effectively using the feature that the digital speaker system 1*f* has the signal processing circuit 10*fr* for outputting right-sound digital signals of six channels and the signal processing circuit 10*fl* for outputting left-sound digital signals of six channels.

The above-described embodiment is an aspect of the present invention, and thus any modification and application may be made within the subject matter of the present invention.

For example, in the above embodiment, plural examples have described with respect to the construction of the speaker system. However, it is needless to say that the construction of the speaker system to which the present invention is applied are not limited to the above examples. That is, the present invention is broadly applicable to a speaker which has a circuit having the same function as the signal processing circuit 10.

Furthermore, in the above embodiment, the signal processing circuit for six channels and the signal processing circuit for eight channels are exemplified as the signal processing circuit 10. However, any number of channels may be adopted as the channel number of the signal processing circuit 10 within the subject matter of the present invention.

DESCRIPTION OF REFERENCE NUMERALS

1, 1*a*, 1*b*, 1*c*, 1*d*, 1*e*, 1*f* digital speaker system
2, 21*a* to 23*a*, 21*b* to 24*b*, 2*c*, 21*d*, 22*d*, 21*e* to 24*e*, 21*f*, 22*f* monaural sound speaker
3, 3*c*, 3*d*, 31*e*, 32*e*, 31*f*, 32*f* right sound speaker
4, 4*c*, 4*d*, 41*e*, 42*e*, 41*f*, 42*f* left sound speaker
10, 10*a*, 10*b*, 10*c*, 10*d*, 10*er*, 10*el*, 10*fr*, 10*fl* signal processing circuit

The invention claimed is:

1. A digital speaker system, comprising:

a plurality of speakers; and a signal processing circuit that outputs a plurality of right-sound digital signals and a plurality of left-sound digital signals, wherein at least one of the plurality of speakers is operated to function as a monaural sound speaker, the monaural sound speaker includes a single bobbin, at least one right-sound voice coil arranged around the single bobbin, and at least one left-sound voice coil arranged around the single bobbin, and the number of the right-sound voice coil equals to the number of the left-sound voice coil, wherein the signal processing circuit inputs a right-sound digital signal to the right-sound voice coil, the signal processing circuit inputs a left-sound digital signal to the left-sound voice coil, and the monaural sound speaker combines the right-sound digital signal and left-sound digital signal to output monaural sound.

2. The digital speaker system according to claim 1, further comprising: a right sound speaker to which one or plural right-sound digital signals that are not input to the monaural sound speaker are input to output right sounds, and a left sound speaker to which one or plural left-sound digital signals that are not input to the monaural sound speaker are input to output left sounds.

3. The digital speaker system according to claim 1, wherein the plurality of speakers comprise a same number of voice coils.

4. The digital speaker system according to claim 1, wherein the plurality of speakers are configured to be a same type.

5. The digital speaker system according to claim 1, wherein one or plural right-sound digital signals are input to the at least one voice coil of speakers other than the at least one speaker for outputting the monaural sounds to output right sounds, and one or plural left-sound digital signals are input to the at least one voice coil of speakers other than the at least one speaker for outputting the monaural sounds and the speakers for outputting the right sounds to output left sounds.

* * * * *